US005569889A

United States Patent [19]

Bruner

[11] Patent Number: 5,569,889

[45] Date of Patent: Oct. 29, 1996

[54] KEY ASSEMBLY AND KEYBOARD COMPRISING KEY RETRACTION AND STABILIZATION MEANS

[75] Inventor: David A. Bruner, Cary, N.C.

[73] Assignee: Ericsson GE Mobile Communications Inc., Research Triangle Park, N.C.

[21] Appl. No.: 218,576

[22] Filed: Mar. 28, 1994

[51] Int. Cl.[6] ..... H01H 13/70

[52] U.S. Cl. ..... 200/5 A; 200/517; 200/345

[58] Field of Search ..... 200/5 A, 43.11, 200/43.13, 43.16, 43.18, 512–517, 520, 318.1, 318.2, 329, 341–345; 400/472, 480, 481, 490, 491, 491.2, 495, 496

[56] References Cited

U.S. PATENT DOCUMENTS

| | | | |
|---|---|---|---|
| 3,574,335 | 4/1971 | Ricke | 235/145 |
| 3,800,104 | 3/1974 | Lien et al. | 200/5 A |
| 3,982,081 | 9/1976 | Demler, Jr. | 200/5 R |
| 4,029,916 | 6/1977 | Chu | 200/5 A |
| 4,032,729 | 6/1977 | Koistinen | 200/5 A |
| 4,096,364 | 6/1978 | Lynn | 200/5 A |
| 4,190,748 | 2/1980 | Langford | 200/5 A |
| 4,315,114 | 2/1982 | Monti, Jr. | 200/5 A |
| 4,351,988 | 9/1982 | Albright | 200/5 A |
| 4,359,612 | 11/1982 | Rooney | 200/5 R |
| 4,359,613 | 11/1982 | Rooney | 200/5 R |
| 4,430,531 | 2/1984 | Wright | 200/5 A |
| 4,582,967 | 4/1986 | Brumit | 200/5 A |
| 4,618,744 | 10/1986 | Pope | 200/5 A |
| 4,764,770 | 8/1988 | Church | 340/365 R |
| 4,827,243 | 5/1989 | Cheng | 341/22 |
| 5,003,140 | 3/1991 | Abell, Jr. et al. | 200/344 |
| 5,163,765 | 11/1992 | Levy | 400/492 |
| 5,268,545 | 12/1993 | Bruner | 200/345 |

*Primary Examiner*—Brian W. Brown
*Assistant Examiner*—Michael A. Friedhofer
*Attorney, Agent, or Firm*—Steven J. Hultquist; Charles L. Moore, Jr.

[57] ABSTRACT

A retractable key assembly comprising a key top and an externally extending pivot arm. The pivot arm allows arcuate movement of the key top about a pivot axis such that the key top can be used in an upper, active keying position or stored in a lower, inactive position. The use of a pivot arm enables a lower profile keyboard when the keyboard is in the retracted, inactive position. Displacement of the internal actuation assembly allows the keytop to actually rest on the keyboard base. A translatable base member is useful to raise or retract the key assembly. The disclosed key assembly provides an aesthetic appearance and improved keying accuracy, relative to conventional keyboard arrangements.

19 Claims, 4 Drawing Sheets

KEY ASSEMBLY AND KEYBOARD COMPRISING KEY RETRACTION AND STABILIZATION MEANS

BACKGROUND OF THE INVENTION

1. Field of the Invention

The present invention relates to a key assembly, and to a keyboard comprising an array of such key assemblies, in which the keytop elements of the key assemblies are retractable, being translatable between a raised active position and a retracted, "low profile" inactive position.

2. Description of the Related Art

In the field of computer technology, there has been a continuing evolution of efforts to reduce the size and weight of computer equipment, under the impetus of ongoing developments in microcircuitry products resulting in memory and processor chips of exceedingly small size and exceedingly high memory capacity and processing (clock speed) characteristics, respectively.

These efforts to reduce the size and weight of computer equipment, particularly in personal computers such as notebook, palmtop, and personal digital assistants, have also been focused in part on the mechanical user interface, which typically includes a keyboard.

The keyboard may be of various types, including a full-size or extended keyboard, or the keyboard may comprise, particularly in the case of palmtop and sub-notebook computers, a keypad having a relatively smaller number of key elements than full-size or extended keyboards.

In particular, there is a need to provide keyboards having improved "low profile" character, in respect of the height of the keytop elements from the base surface of the keyboard. The keytop elements must of course be of "raised" character during the operation of the keyboard, in order to be depreciable, or actuatable, by the fingers of the keyboard user. The keytop element is depressed by the user's finger, and typically associated with such element is a switch or contact structure which in the depressed position of the keytop functions to produce a signal yielding the desired keying character. There have been various prior art efforts to reduce the thickness or profile height of the key assemblies of the keyboard. While these and other efforts to reduce the size and increase the compactness of computer keyboards have variously produced keyboards of improved character, there is a continuing need in the art to provide further improved keyboards having superior size, weight, and ergonomic characteristics.

U.S. Pat. No. 4,096,364 issued Jun. 20, 1978 to W. J. Lynn, et al describes a keyboard having a plurality of domes which are depressible by buttons having actuator portions. The domes have a snap initiator at the top thereof, so that buttons having a relatively tiny actuator portion, a pair of raised surfaces, serving as actuator portions, or other shaped actuators can be utilized. The dome and keyswitch structure is shown in FIG. 5 of the patent in one embodiment. The patent discloses the use of a hidden pivot element for stabilization of the keyswitch.

U.S. Pat. No. 4,029,916 issued Jun. 14, 1977 to P-J Chu describes snap-action push-bottom switches having a prestrained dome-shape spring contact plate undergoing snap-action after a predetermined amount of applied for, and snaps back after removal of the force. A living hinge structure is described, involving a combined switch and tactile element.

U.S. Pat. No. 3,982,081 issued Sep. 21, 1986 to H. W. Demler, Jr. discloses a keyboard having integral switch and spring members formed from a single piece of plastic material or sheet metal.

U.S. Pat. No. 4,315,114 issued Feb. 9, 1982 to J. H. Monti, Jr. describes a telephone push button dialer-keyboard, comprising key elements which are adapted to be actuated on depression. The key elements are hinged to a cross brace or transverse support member, which in turn has hinged thereto a plurality of buttons of one alignment. The keyboard utilizes hidden pivot arms and living hinge stabilizers.

U.S. Pat. No. 4,582,967 issued Apr. 15, 1986 to D. D. Burmit, et al discloses a keyswitch formed in a one-piece cantilever assembly with an actuated arm connected by a living hinge to the body member, with the keyswitch being insertable between the top cover plate and the substrate, and the body member serving to maintain the spacing between the substrate and the cover plate. The under side of the keyswitch carries a bell-shaped actuator bar contacting a subjacent contact element or dome. The actuator arm features a projection on its upper surface which extends through an aligned aperture in the top cover plate to receive the T cap.

U.S. Pat. No. 4,827,243 issued May 2, 1989 to S.-C. Cheng discloses a keyboard button structure as shown in the exploded view of FIG. 1 in the patent. Each key button has a U-shaped guide plate on its lateral sides with a hollow guide pan extending downwardly from the button and a pall-like sheet at its bottom end. Holes in the housing panel receive the button, and a rubber dome element 6 is interposed between the button and panel to provide button return.

U.S. Pat. No. 4,764,770 issued Aug. 16, 1988 to R. L. Church describes a stabilized molded rubber keyboard, in which the keyboard comprises a rubber base sheet that directly overlies a PC board and a series or rubber keys or key caps integral with the base sheet. On the upwardly recessed bottom surfaces of each key is provided switch-contact members. A stabilizing membrane snugly engages each key, and is flexible along a Z axis and is sufficiently restrained in x and y directions to limit key movement to a substantially strictly linear movement with reference to the PC board switch contacts. The keys described in this patent are of a non-pivoting type.

U.S. Pat. No. 4,618,744 issued Oct. 21, 1986 to K. M. Pope, et al describes a keyboard including elastomeric dome keypads. Rocker mounted keys as shown in FIG. 2 of the patent are positioned to actuate the domes of the keypad. The patent describes the rotary mounting means for attaching the keys to a bezel position to overly the elastomer dome keypad, such that the travel path of the keys is arcuate. The rotary mounting means may comprise at least one aperture formed in the flange of each of the keys and a corresponding protrusion aligned with the aperture in the flange and extending outwardly from the bezel on the side thereof facing the elastomer dome keypad.

U.S. Pat. No. 4,430,531 issued Feb. 7, 1984 to A. J. Wright describes a keyboard having snap disc switching elements with domed central portions and peripheral foot portions. In this keyboard, each disc is joined by a single strap to a pair of tabs and is positioned on a supporting substrate by means of holes in the strap and mating locator pins. The pins may be employed for fastening the disc to the substrate. A sheet of resilient material is placed over the discs and hingedly mounted keys act on the disc through the resilient sheet.

U.S. Pat. No. 4,359,613 issued Nov. 16, 1982 to C. E. Rooney discloses a keyboard including a plurality of keys which are individually supported for selective depression thereof, wherein the keys are operably coupled to output means by structure including an elongated, resilient element for each key and having a shiftable operating portion. Means operably interconnect keys and associated elements for shifting of the operating portions of the element in response to depression of specific keys. In one embodiment the keyboard includes a plurality of keys with an elongated, generally horizontally extending support arm assembly secured to each key, with certain of the arms extending in a first direction and with others extending in a second direction, and with the respective arms being mounted for pivotal movement about generally horizontal axis spaced from the associated keys.

U.S. Pat. No. 4,359,612 issued Nov. 16, 1982 to C. E. Rooney describes a keyboard and structure thereof operably coupling the keys with output means. The coupling structure includes an elongated, resilient element associated with each key, together with means for shifting the element in response to depression of associated key, and means for disengaging the element in its shifted condition and allowing same to "snap back" to an original rest position. Output means include a microswitch which senses the shifting movement of the resilient element, and develops and electric output signal. U-shaped shifting members are utilized which engage U-shaped resilient elements supporting one or more upstanding encoding posts, to facilitate pocking of the U-shaped element and disengagement from the shifting member, to effectuate the snap-back action.

U.S. Pat. No. 4,351,988 issued Sep. 28, 1982 to F. E. Albright discloses a keyboard assembly in which the switch actuating means for the keys is of arcuate configuration cantileveredly extending beneath the key from one side thereof to an opposite side thereof and positioned to engage the switching means when the key is depressed.

U.S. Pat. No. 4,190,748 issued Feb. 26, 1980 to G. B. Langford describes a keyboard switch assembly utilizing membrane switches and rubber dome tactile members. Keyswitchs are operated by hinged key actuators in the disclosed keyboard switch assembly.

U.S. Pat. No. 4,032,729 issued Jun. 28, 1977 to C. W. Koistinen describes a low profile keyboard switch utilizing hinged actuator and cantilevered beam snap action contacts.

U.S. Pat. No. 3,800,104 issued Mar. 26, 1974 to W. A. Lien, et al describes a low profile keyboard switch assembly including pivoting stabilizer having a pivot point which is part of the previous row of buttons, and in which the pivot arm is hidden. In the disclosed assembly, a single sheet of conductive material is fabricated to include a cantilevered arm having two portions, including a deformed first portion providing a relatively shorter support arm and a remaining, relatively longer tongue member stressed into a convex or concave configuration. At the free end of the cantilever is provided a contact adapted to engage the terminal.

U.S. Pat. No. 3,574,335 issued Apr. 13, 1971 to H. Ricke describes a keyboard having interconnected keys, as shown in FIG. 2 of the patent, in which each key means includes a finger piece, a connecting arm and a support arm, with the support arm of each key means located under the finger piece to the respective adjacent preceding key means of the row, and having a guide means such as rectangular opening for guiding the connecting arm on the preceding key means passing through the opening.

U.S. patent application No. 07/993,192 filed in the name of David A. Bruner, and now allowed, discloses a low profile tactile keyswitch including a horizontally positioned elastic column spring which buckles under an axial load to provide a tactile field for the keyswitch. The ends of the elastic column spring are maintained between two spring holders which are urged together as the key button is pressed, with stabilizing arms pivotally attached to the key button being used to stabilize the key button and also to carry extensions which engage the spring holders to move them together as the key button is depressed. In such keyswitch, lowering of the key button may be effected without placing the elastic column spring under added compression, when the keyswitch is in an inactive configuration.

Accordingly, it is an object of the present invention to provide a key assembly, and a keyboard comprising an array of such key assemblies, which are highly compact in character.

It is another object of the invention to provide a key assembly and keyboard of such type, wherein the keytop elements are retractable from (i) a raised active use position (:in which the keytop elements are selectively manually actuatable to input keying characters or other information into the device with which the keyboard is associated, to (ii) a retracted, "low profile" inactive position.

Other objects and advantages of the invention will be more fully apparent from the ensuing disclosure and appended claims.

SUMMARY OF THE INVENTION

In a broad aspect, the present invention relates to a key assembly having utility in a keyboard or key pad, wherein the keying structure is selectively retractable from an active state in which the keytop is selectively depressible between an upper non-actuated position and a lower actuating, and a retracted position in which the keytop is positioned in an inactive state on a base or support structure having the key assembly mounted thereon, so that a "low profile" keyswitch structure is provided.

The keytop in such assembly may be suitably joined to pivot arm structure, in which a first end of the pivot arm is mounted on the base structure for pivotal movement about a pivot point defined by the locus of the mounting structure, and a second end of the pivot arm opposite the first end is joined to the keytop, with means being provided for biasing the keytop in an upper non-actuated state in the active position and accommodating selective manual depression of the keytop to a lower active state in which signal generating means are actuated to reflect depression of the key and inputting of information thereby. The key assembly further comprises a laterally selectively translatable activating structure which co-acts with the keytop and pivot arm structure to position the keytop in the active position, and selectively translatable to retract or lower the keytop and associated pivot arm, to place the keytop and pivot arm structure in an inactive position.

The laterally translatable activation means may for example comprise a sliding support member on a substrate which contains a pedestal or other protuberant element thereon which serves to physically engage and upwardly translate the keytop and pivot arm structure, when the activating means are translated to a first position, and correspondingly disengaging the keytop and pivot arm structure when the activation means are to a second position.

In one specific embodiment, the present invention relates to a key assembly, comprising:

A keytop having a main top surface and a main bottom surface;

an elastic column joined to the main bottom surface of the keytop and vertically collapsible from an uncollapsed, vertically extended first position to a collapsed, vertically compressed second position, said elastic column having a lower extremity;

a support element joined to said lower extremity of said elastic column;

means for stabilizing and positioning the keytop, comprising a stabilizer arm joined to the keytop and extending exteriorly therefrom to a terminus including a pivotal translation structure about which the keytop can be selectively pivotally positioned;

a bearing surface which is selectively translatable between a registered position with the support element, and a non-registered position with the support element, arranged such that movement of the bearing surface structure to the registered position causes the keytop to be pivotally translated by the stabilizer arm to a raised active position, and translation of the bearing surface structure to the non-registered position causes the keytop to be pivotally translated by the stabilizer arm to a down, inactive position; and means for transmitting a signal which the keytop is depressed while the bearing support member is in the registered position.

In another aspect, the invention relates to a keyboard comprising an array of the above-described key assemblies, including keytops arranged in the array in sequential horizontally-extending, vertically spaced-apart rows. Preferably, the keytops are arranged in the array in successive horizontally extending rows which are staggered from row-to-row, so that (with respect to at least some of the key assemblies in the array) the vertically extending stabilizer element of a key assembly extends upwardly in the array to the next row between adjacent key assemblies, and so that the keys are in transversely horizontally spaced-apart relationship to one another.

Other aspects and features of the invention will be more fully apparent from the ensuing disclosure and appended claims.

DETAILED DESCRIPTION OF THE INVENTION, AND PREFERRED EMBODIMENTS THEREOF

The present invention reflects the discovery of a key assembly and actuator mechanism which is constructed so that the key assembly comprising the keytop joined to one end of a pivot or stabilizer arm, and arcuately translatable about its opposite end, may be selectively retracted to a very low height profile, by means of a slidably engageable and disengageable actuator comprising a support element which is selectively slidably translatable under the keytop to raise the keytop and associated pivotal stabilizer arm to an upper, active position, in which position the keytop may be selectively manually depressed to input data or otherwise perform keying operations, and with the slidably translatable actuator means being slidably retractable to lower the key to the low profile, lower inactive position.

Figure 1:
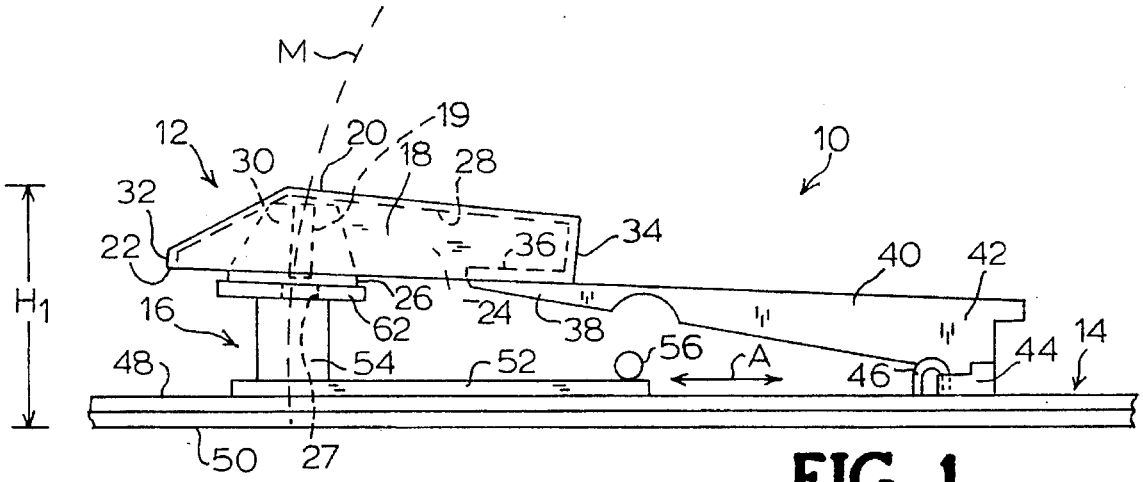
FIG. 1 is a side elevation view of a portion of a keyboard, showing an illustrative key assembly accordingly one embodiment of the present invention.

Referring now to the drawings, FIG. 1 shows a side elevation view of a portion of a keyboard 10 according to one embodiment of the present invention, comprising a key assembly 12, a base structure 14, and an actuator mechanism (support structure) 16.

The key assembly 12 comprises a keytop 18 having main top surface 20 on which manual pressure may be selectively exerted to depress the key when in the upper, active position shown in the drawing. The keytop 20 as illustrated and also as shown in plan view in FIG. 4 in the upper, active position, has a hollow construction with the key top housing 22 enclosing an interior volume 24 in which is mounted on the main bottom surface 28 of the keytop a keytop post element 19, and a collapsible dome element 30 which is vertically collapsible along the arcuate translation axis M, when the keytop 18 is selectively manually depressed on its top main surface 20.

The housing 22 of the keytop at a rearward portion thereof (the front or distal surface of the keytop 18 comprising front surface 32 and the rear or proximal portion of the keytop 18 comprising rear surface 34) includes a lower rear flange 36, to which is joined the front end portion 38 of pivot arm 40. The pivot arm is sometimes referred to herein as a stabilizer arm, it being understood that such terminology is used interchangeably to denote the appertaining structure in the key assembly and keyboard of the present invention. The keytop and stabilizer arm may be integrally formed or may be separately fabricated and joined to each other in any suitable manner, e.g., by soldering, welding, bonding, mechanical fastening, etc.

Figure 4:
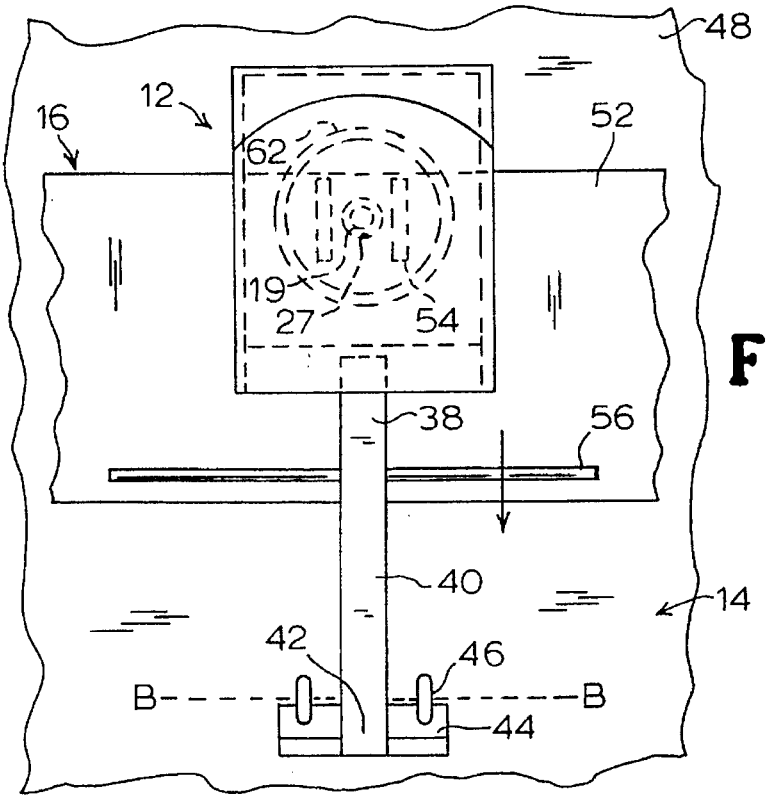
FIG. 4 is a top plan view of the FIG. 1 keyboard portion.

The rear portion 42 includes marginally extending side flanges 44, as shown in plan view in FIG. 4. The flanges 44 are in turn secured to the base structure 14 by means of eyelet elements 46 which are of generally inverted "U"-shape and secured at the bottom extremities of the legs thereof to the pressure-sensitive switch layer 48, which in turn is reposed on base layer 50. The base layer may for example be formed of conventional circuit board substrate materials such as a non-conductive polymeric material, or stamped metal.

The coupling of the pivot arm 40 to the pressure-sensitive switch layer 48 via the eyelet elements 46 thus permits the pivot arm 40 to pivotally translate about the horizontal axis B—B shown in FIG. 4, so that the keytop 18 joined to the front portion 38 of the pivot arm is selectively arcuately translatable along an arc M associated with the collapsible dome element 30 (i.e., each portion of the pivot arm and keytop anterior to the pivot axis B—B will be selectively arcuately translatable along an arc which is concentric with and parallel to the arc M when the key assembly is viewed in side elevation view as in FIG. 1).

The actuation assembly (support structure) 16 comprises a slidably translatable base member 52, on the front portion of which is an elevation member 54 such as the protrusions shown, it being understood that the elevation member 54 may of any suitable shape and configuration. On the rear portion of the base member 52 is a translation member 56, which in the embodiment shown is a wire element which is suitably coupled (via and to further means not shown) to structure effecting the selective slidable translation of translation element 56 and the base member 52 and elevation element 54 in either the forward and rearward directions indicated by bidirectional arrow A in FIGS. 1 and 4.

Figure 2:
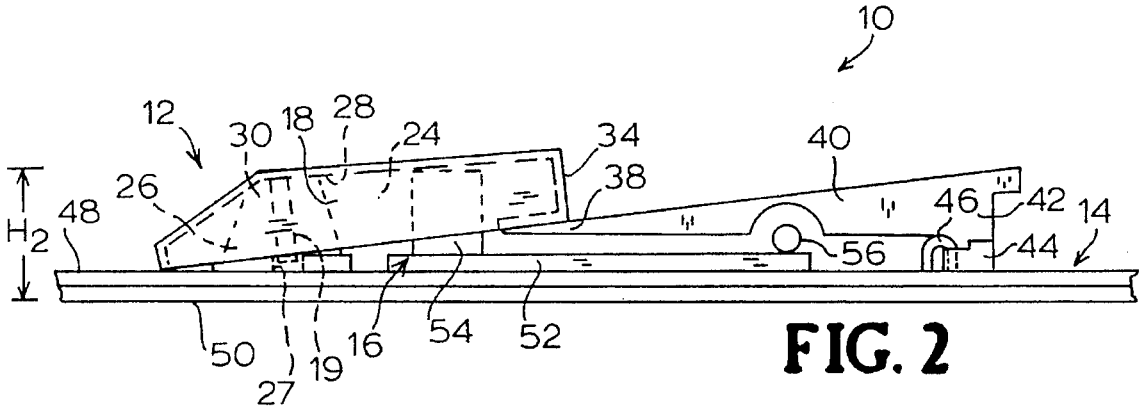
FIG. 2 is a side elevation view of the side elevation view of the portion of the keyboard shown in FIG. 1, with the actuator assembly withdrawn to effect retraction of the key and pivot arm, to a down, inactive position.

The translation element 56 may for example extend across the full transverse extent of a keyboard comprising a multiplicity of key assemblies as shown in FIGS. 1 and 4, and be connected at margins of the keyboard to guide means or other structure for translating the actuator assembly selectively forwardly to the active position shown in FIG. 1, or rearwardly to a retracted position as shown in FIG. 2, in which the key assembly 12 is in a lower, inactive position, with the elevation element 54 being reposed in the interior volume 24 of the keytop 18, posteriorly of the dome element 30.

As shown in FIG. 2, when the actuator assembly 16 has been rearwardly retracted to its maximum rearward position, the translation element 56 thereafter may be forwardly translated to effect raising of the key assembly 12 and positioning of the keytop 18 in the upper, active position as shown in FIG. 1.

With reference to FIG. 1, the rubber dome element 26 has a main body portion 30 which is secured in the interior volume 24 of the keytop, being joined to main bottom surface 28 of the keytop. The collapsible dome element 26 at its lower portion is coupled with a lower containment ring 62 having a central opening 27 therein, though which post 19 can pass when the dome element 26 is collapsed as the key is depressed in the active position. The collapsible dome element is preferably constructed of material selected from the group consisting of natural and syntheic rubbers, and polymeric elastomeric materials. The ring 62 thereby is arranged so that post 19 can pass through opening 27 and exert pressure on sensitive switch layer 48, to effect keying input in the keyboard device, as shown in FIG. 3 hereof, wherein all parts and elements are numbered correspondingly with respect to FIGS. 1, 2 and 4.

Figure 3:
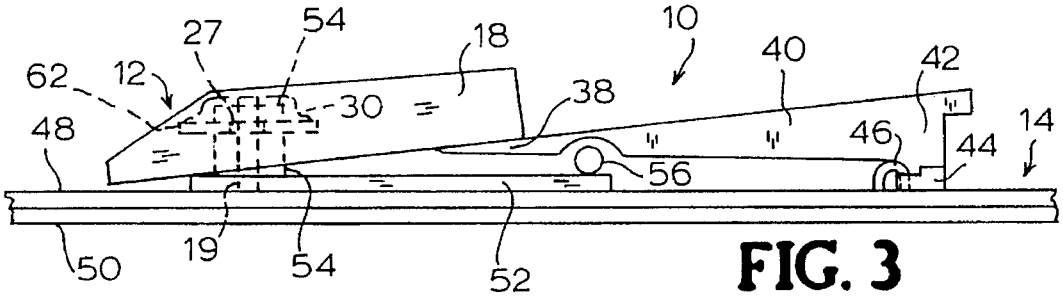
FIG. 3 is a side elevation view of a portion of the keyboard of FIG. 1, showing the key and pivot arm as being depressed to actuate keying input to an associated processor unit.

As shown in the top plan view of FIG. 4, the elevation element 54 may comprise two elevation flange members which are in transversely spaced relationship to each other as shown, and arranged so that the lower containment ring 62 may rest on top of the flanges as the keytop 18 is manually depressed from the upper, active position shown in FIG. 1 to the lower, active position shown in FIG. 3.

When the key assembly is positioned with the keytop in the lower, active position as shown in FIG. 3, the contact made by the post 19 with the pressure-sensitive switch layer 48 produces a signal indicative of the keying operation which may be used to input data or other information to a central processor unit or other component of the keyboard device or peripheral device associated therewith.

Figure 5:
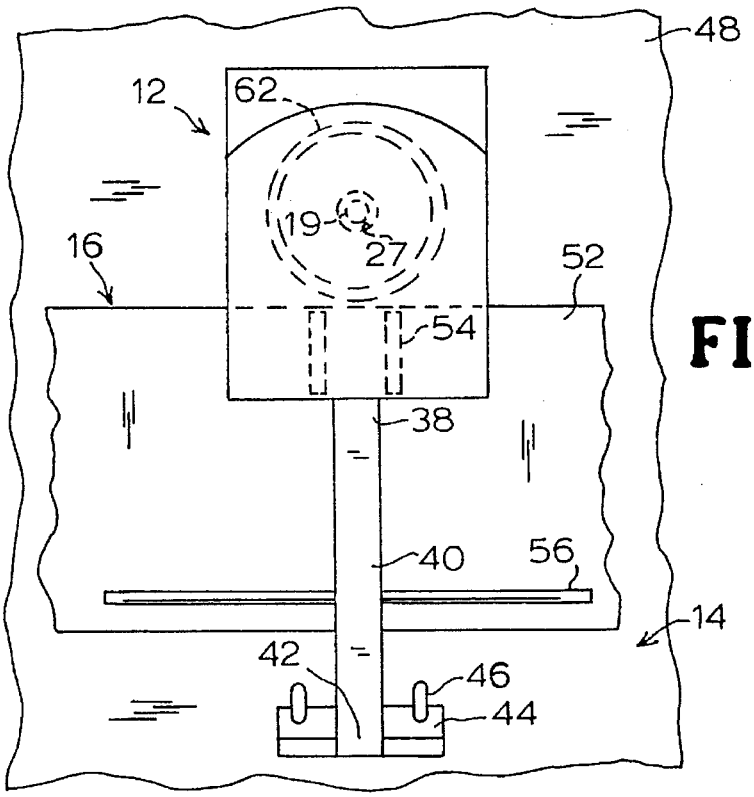
FIG. 5 is a top plan view of the FIG. 2 keyboard portion.

FIG. 5 is a top plan view of the portion of the keyboard shown in FIG. 2, wherein the key assembly 12 is in the lower, inactive position, with the actuator assembly 16 being fully rearwardly retracted, so that the lower containment ring 62 coupled to the collapsible dome element 26 is reposed on the pressure-sensitive switch layer 48, but post 19 is not in contact with the pressure-sensitive switch layer 48 in such position.

By the foregoing arrangement, the keyboard structure has a height $H_1$ as shown in FIG. 1, which may for example be on the order of 9–10 mm. When the actuator assembly is retracted and the key assembly is lowered to the lower, inactive position shown in FIG. 2, the corresponding height $H_2$ of the keyboard portion shown in FIG. 2 may be on the order of 6 mm.

It will be recognized from the foregoing that the key assembly, base structure and actuator assembly of the keyswitch unit of the present invention may be widely variously configured, for a specific end use application, as generally comprising a key assembly which is arranged with a keytop element coupled with an exteriorly extending pivot arm (exteriorly extending from the keytop element to a pivot portion which is spatially remote from the keytop), with an actuator means being constructed and arranged to selectively elevate the keytop and associated pivot arm to an upper, active position, in which the keytop is selectively manually depressible to a lower, active keying position, and in which the actuator means may be selectively actuated to disengage the key assembly from the active position and lower the keytop and associated pivot arm to a lower, inactive position.

Figure 6:
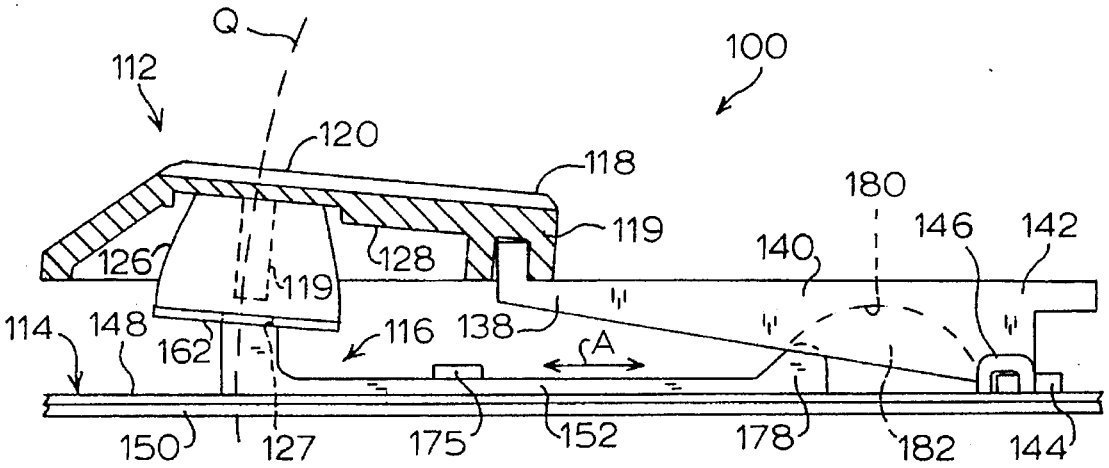
FIG. 6 is a side elevation view of a portion of a keyboard according to another embodiment of the present invention.

FIG. 6 is a side elevation view of a portion of a keyboard 100 comprising key assembly 112, an actuation assembly 116 and a base assembly 114. The key assembly 112 comprises a keytop 118 having a main top surface 120 against which force may be selectively manually directed to effect arcuate translation of the keytop along the arcuate axis Q as shown. The keytop 118 has a main bottom surface 128 on which is mounted a keying post 19 and a downwardly depending dome element 126 which has a vertical axis approximately coincident with the arc Q and is vertically collapsible when the keytop 118 is selectively depressed from the upper, active position shown to a lower, active position as shown in FIG. 8, wherein all parts and elements are numbered correspondingly with respect to FIG. 6, as are the corresponding parts and elements in FIG. 7, which shows the keyboard 100 portion of FIG. 6 in an inactive state, with the keytop 118 and dome element 126 in the lower, inactive position.

Referring again to FIG. 6, the keytop 118 at its rear portion 119 is coupled with the front portion 138 of pivot arm 140, the pivot arm having a rear portion 142 constructed with transversely outwardly extending flanges 144 coupled in turn to mounting bracket 146 of inverted "U" shape, as shown.

Figure 8:
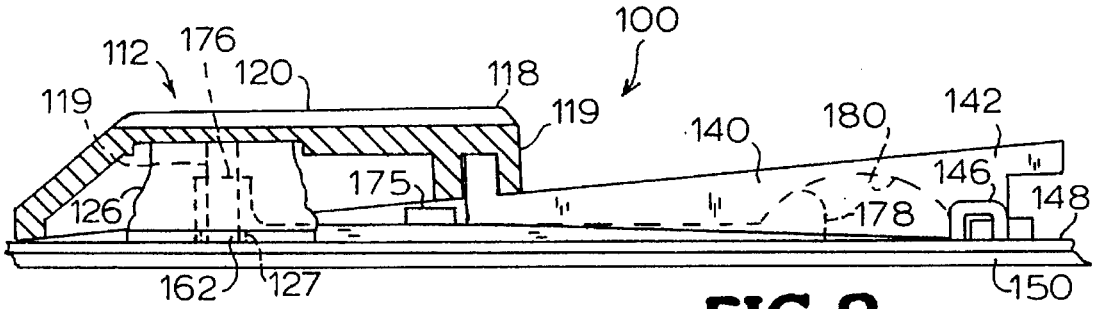
FIG. 8 is a side elevation of the FIG. 6 keyboard portion, showing the keytop as being selectively depressed to a down, active position.

The collapsible dome element 126 is joined at its lower extremity to a lower containment ring 162 having opening 127 therein accommodating passage of keying post 19 therethrough when the key is depressed to the lower active position as shown in FIG. 8, so that the keying post 19 contacts the pressure-sensitive switch layer 148, to effect inputting of data or information, in the previously described manner, via simple circuitry or other input structure associated with the switch layer 148. The substrate assembly 114 further comprises a substrate layer 150 on which the pressure-sensitive switch layer 148 is reposed, in a manner conventionally utilized in the art for fabrication of keyboard structures.

Figure 7:
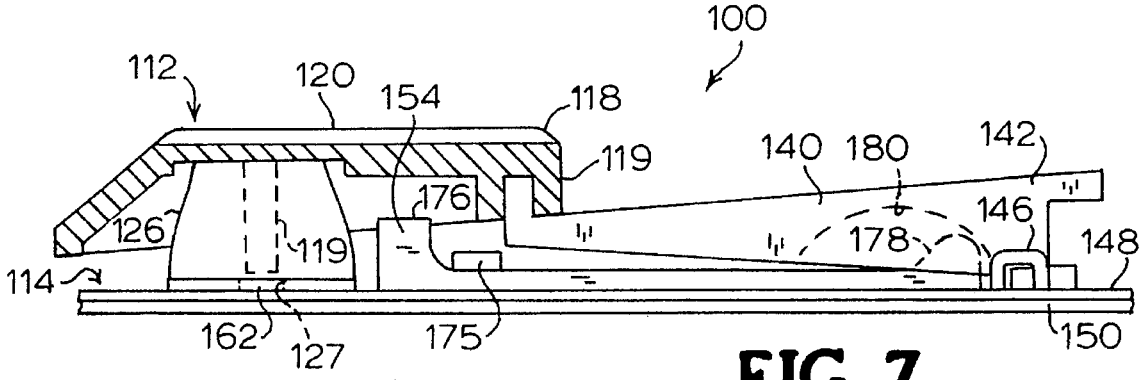
FIG. 7 is a side elevation view of the FIG. 6 keyboard portion, showing the actuator as being retracted so that the key assembly is in a down, inactive position.

The actuation assembly 116 comprises a slidable base member 152, which is selectively translatable in the directions indicated by arrow A in FIG. 6, between a forwardly extended actuating position as shown in FIG. 6, and a rearwardly translated inactive state as shown in FIG. 7, in which the stop element 175 functions to restrain the actuation assembly 116 from further rearward movement.

The actuation assembly 116 at the front portion thereof has a protrusion element 154 integral therewith, and having upper bearing surface 176, on which the lower containment ring 162 is reposed when the key is in the upper, active position as shown in FIG. 6.

The means for selectively forwardly and rearwardly translating the reciprocatable sliding base member 152 in this embodiment comprises a rear portion of the actuator assembly which is integral with the base member 152 and is cam-shaped, to form a camming element 178. The camming element 178 is selectively engageable with complementarily matable camming surface 180 of the pivot arm 140, to effect raising of the key assembly 112 to the upper, active position when the base member 152 is forwardly translated, and retraction of the key assembly 112 when the base member is rearwardly translated, so that the key assembly is lowered to the lower, inactive position shown in FIG. 7. The camming surface 180 in the interior rear portion of the pivot arm 140 defines an interior cavity 182, in which the rear cam-shaped portion 178 of the actuator assembly 116 is forwardly and rearwardly translatable. When the key assembly 112 is in the upper, active position shown in FIG. 6, manual depression of the keytop 118 will result in compaction of the pivot arm at the camming surface 180 in contact with the cam-shaped portion 178, the pivot arm 140 in such embodiment being formed of a resilient, deformable elastic material, or being of hollow construction with a resilient, deformable insert therein, accommodating depression of the keytop 118 to the lower active position shown in FIG. 8.

Figure 9:
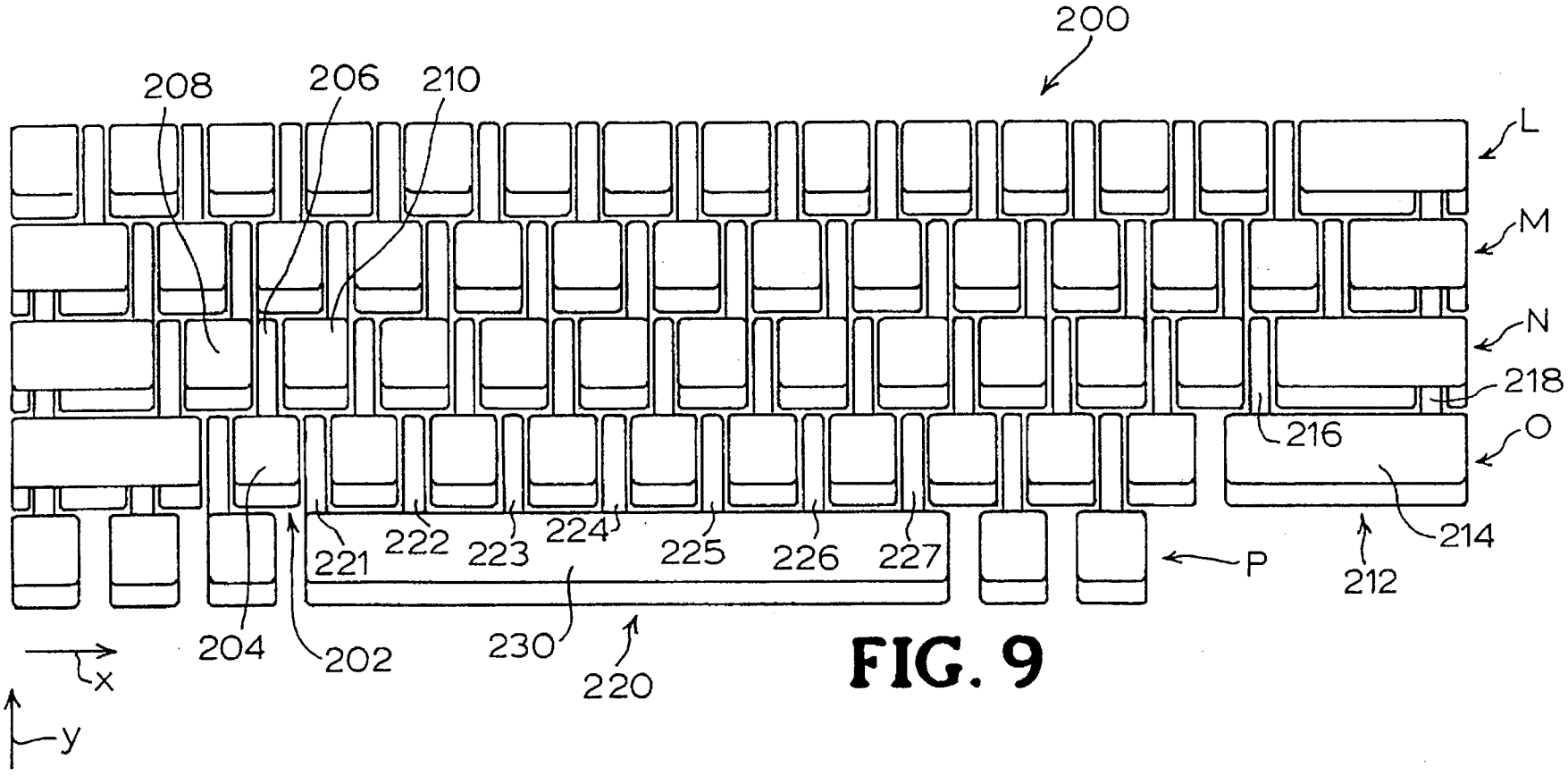
FIG. 9 is a top plan view of a keyboard comprising key assemblies according to one embodiment of the present invention.

FIG. 9 is a top plan view of a key board 200 shown in a generalized schematic form, as comprising an array of key assemblies 202 including keytops arranged in the array in sequential horizontally extending (in the direction indicated by arrow X), vertically spaced-apart (in the direction indicated by arrow Y) rows designated by the letters "L", "M", "N", "O", and "P".

Each of the keytops may be formed in any suitable manner consistent with the invention as broadly disclosed hereinabove, and each keytop is coupled (either integrally, or by joining or connecting of the keytop to the pivot arm) with a pivot arm exteriorly extending from the keytop, as shown in the drawing.

In this arrangement, the pivot arms of the respective keys extend forwardly (in the Y direction) in the array to the next row of keytops and between adjacent key tops of the vertical row, over at least a portion of the key board, as illustrated. For example, key assembly 202 comprises a key top 204 which is connected to or integrally formed with a pivot arm 206, extending into row N of the key board array of keytops, between keytop 208 and keytop 210. By this arrangement, the pivot arm 206 serves as a spacer element between keytops 208 and 210, and contributes a highly aesthetic appearance to a keyboard, as well as serving a spacer function which improves the keying accuracy and minimizes mis-keying which may result from inaccurate finger contacting with the keytops in the array.

In the case of the some of the keys in the array shown in FIG. 9, such as shift key assembly 212, comprising keytop 214 and pivot arms 216 and 218, a multiplicity of pivot arms may be employed, at least one of which is "exposed" and employed as a spacer element in the next vertically adjacent row (pivot arm 216 in row N) and at least one of which is "hidden" under a keytop of the next adjacent row (pivot arm 218 in row N).

The array shown in FIG. 9 also includes a spacer key assembly 220 comprising a spacer keytop 230 having associated therewith multiple "exposed" pivot arms, 221, 222, 223, 224, 225, 226 and 227.

It will be recognized that the keyboard shown in FIG. 9 may be modified to include key assemblies including one or more pivot arms which are "hidden" under a next vertically adjacent row keytop(s).

It will be appreciated from the foregoing that the key structure of the present invention, including a keytop, tactile element such as the collapsible dome element herein illustratively described, and a pivot arm, permit selective raising and lowering of the keytop elements of the keyboard, between an upper, active position and a lower, inactive position, and wherein in the upper, active position, the keytops are selectively individually depressible in conventional keying fashion. Such arrangement permits the keyboard to possess a retracted keytop height which is extremely thin, e.g., on the order of 6 mm, significantly lower in profile than keyboards of the prior art of which I am aware.

It will be recognized that the invention may be significantly modified, such as for example by utilizing different tactile elements in place of the illustratively described rubber dome element, such as a buckleable spring, or other compressibly deformable resilient "memory" element, and the shape and operation of the pivot arms may be modified, as well as the configuration and operation of the actuation assembly, for raising or lowering (retraction) of the keytop(s) associated therewith. For example, as embodied in a notebook or laptop personal computer, the keyboard of the present invention may be configured so that the retraction (actuator assembly) means are mechanically and/or electrically coupled with the hinge, latch or other means constituting operative parts of an openable/closeable casing, so that the keytops of the keyboard are retracted upon closure of the casing, and the keytops are elevated to the upper, active position when the casing is opened.

Thus, while specific features, aspects and embodiments of the present invention have been illustratively disclosed herein, it will be appreciated that other variations, modifications, and alternative embodiments may be utilized, and accordingly, all such variations, modifications, and alternative embodiments are to be regarded as being within the spirit and scope of the present invention.

What is claimed is;

1. A key assembly having utility in a keyboard or key pad, and comprising:

a base;

a keying structure mounted on the base and including a keytop and a pivot arm coupled to the keytop;

said pivot arm extending exteriorly from the keytop to an exterior extremity;

means joined to said exterior extremity for mounting said pivot arm on the base and allowing pivotable translation of the keytop and pivot arm;

and means for selectively retracting the keying structure from (i) an active state in which the keytop is selectively depressible between an upper non-actuated position and a lower actuating position, and (ii) a retracted position in which the keytop is positioned in an inactive state on the base.

2. A key assembly according to claim 1, wherein the pivot arm comprises first and second ends at opposite extremeties of the pivot arm, with the first end of the pivot arm being mounted on the base for pivotal movement about a pivot axis defined by the means for mounting said pivot arm on the base, and the second end of the pivot arm opposite the first end being joined to the keytop.

3. A key assembly according to claim 1, further comprising means for biasing the keytop in the upper non-actuated position in the active state and accommodating selective manual depression of the keytop to the lower actuating position.

4. A key assembly according to claim 1, further comprising a post depending downwardly from the keytop, and a pressure sensitive switch layer on the base arranged so that the post is (i) in non-contacting relationship to the pressure-sensitive switch layer when the keytop is in the upper non-actuated position, and (ii) in contacting relationship to the pressure-sensitive switch layer when the keytop is in the lower actuating position.

5. A key assembly according to claim 1, wherein the retracting means comprise a laterally selectively translatable activating structure which co-acts with the keytop and pivot arm to position the keytop in the active state, and is selectively translatable to retract the keytop and pivot arm, to place the keytop and pivot arm in the inactive state.

6. A key assembly according to claim 5, wherein the laterally selectively translatable activating structure comprises a sliding support member on the base and a protuberant element on the support member to physically engage and upwardly translate the keytop and pivot arm, when the activating structure is translated to a first position, and correspondingly disengaging the keytop and pivot arm when the activating structure is translated to a second position.

7. A key assembly comprising:

a base;

a keytop having a main top surface and a main bottom surface;

an elastic column joined to the main bottom surface of the keytop and vertically collapsible from an uncollapsed, vertically extended first position to a collapsed, vertically compressed second position, said elastic column having a lower extremity;

a support element joined to said lower extremity of said elastic column;

means for stabilizing and positioning the keytop, comprising a stabilizer arm joined to the keytop and extending exteriorly therefrom to an exterior extremity;

means joined to said exterior extremity for mounting said stabilizer arm on the base and allowing pivotable translation of the keytop and stabilizer arm;

a bearing surface structure on the base which is selectively translatable between a registered position with the support element, and a non-registered position with the support element, arranged such that movement of the bearing surface structure to the registered position causes the keytop to be pivotally translated by the stabilizer arm to a raised active position from which the keytop is selectively depressible to a lower actuating position, and translation of the beating surface structure to the non-registered position causes the keytop to be pivotally translated by the stabilizer arm to a down, inactive position; and a contact structure on the main bottom surface of the keytop, and a pressure sensitive switch layer on the base arranged so that contact structure on the main bottom surface of the keytop is (i) in non-contacting relationship to the pressure-sensitive switch layer when the keytop is in the raised active position, and (ii) in contacting relationship to the pressure-sensitive switch layer when the keytop is in the lower actuating position.

8. A keyboard comprising an array of key assemblies including keytops arranged in the array in sequential horizontal-extending, vertically spaced-apart rows, said key assemblies comprising:

a base;

a keying structure mounted on the base and including a keytop and a pivot arm coupled to the keytop;

said pivot arm extending exteriorly from the keytop to an exterior extremity;

means joined to said exterior extremity for mounting said pivot arm on the base and allowing pivotable translation of the keytop and pivot arm;

and means for selectively retracting the keying structure from (i) an active state in which the keytop is selectively depressible between an upper non-actuated position and a lower actuating position, and (ii) a retracted position in which the keytop is positioned in an inactive state on the base.

9. A keyboard according to claim 8, wherein the keytops are arranged in the array in successive horizontally extending rows which are staggered from row-to-row, with the pivot arm of at least one of the key assemblies extending outwardly in the array to a next row between two adjacent key assemblies of said row, such that these two adjacent key assemblies are in transversely horizontally spaced-apart relationship to one another.

10. A retractable key assembly comprising a keytop coupled with a pivot arm including a pivotally mounted portion of the pivot arm accommodating arcuate movement of the keytop about a pivot axis defined by the pivotally mounted portion of the pivot arm, between an upper, active keying position and a lower, inactive position, with actuating means serving to engage the key assembly and elevate the keytop to the upper, active position accommodating selective application of force to an upper surface of the keytop for keying, and with the actuating means being disengageable from the key assembly, whereby the keytop is lowerable to the lower, inactive position.

11. A keyboard comprising an array of key assemblies, said key assemblies comprising a keytop coupled with a pivot arm including a pivotally mounted portion of the pivot arm accommodating arcuate movement of the keytop about a pivot axis defined by the pivotally mounted portion of the pivot arm, between an upper, active keying position and a lower, inactive position, with actuating means serving to engage the key assembly and elevate the keytop to the upper, active position accommodating selective application of force to an upper surface of the keytop for keying, and with the actuating means being disengageable from the key assembly, whereby the keytop is lowerable to the lower, inactive position, wherein at least one of the pivot arms extends outwardly in the array of key assemblies between two adjacent key assemblies, such that these two adjacent key assemblies are in a spaced-apart relationship to one another.

12. A key assembly comprising a keytop with main top and bottom surfaces, for use in a keyboard including a multiplicity of such key assemblies arranged in an x-y array wherein the keytops in an active state are selectively manually actuatable in a z direction, comprising:

a key assembly base;

a pivotal mount structure positioned on the key assembly base and defining a pivotal translation axis;

a pivotally mounted stabilizer arm having (i) a first end portion joined to the pivotal mount structure for pivotable translation of the stabilizer arm about the pivotal mount structure axis of rotation when the keytop is in the active state, and (ii) a second end portion joined to the keytop;

means for positioning the keytop in an upper elevation position in the active state and permitting the keytop in said active state to be selectively manually depressed in the z direction to a lower actuation position; and a contact structure on the main bottom surface of the keytop, and the key assembly base comprising a main base layer and a pressure sensitive switch layer on the main base layer, arranged so that contact structure on the main bottom surface of the keytop is (i) in non-contacting relationship to the pressure-sensitive switch layer when the keytop is in the upper elevation position in the active state, and (ii) in contacting relationship to the pressure-sensitive switch layer when the keytop is depressed in the z direction to the lower actuation position.

13. A key assembly according to claim 12, wherein said means for positioning the keytop in an upper elevation position includes a slidably translatable member mounted on the key assembly base.

14. A key assembly according to claim 12, wherein said positioning means comprise:

a retraction member mounted on the keyboard assembly base, for slidable movement thereon in the y direction between a retracted first position and an active state second position, said retraction member including an extension portion for supportively elevating the keytop to the upper elevation position when the retraction member is in the active state second position, and said retraction member extension portion being non-engaged with the keytop when the retraction member extension portion is in the retracted first position; and a biasing element for biasingly maintaining the keytop in the upper elevation position in the absence of selective manual depression of the keytop when the retraction member is in the active state second position and the keytop is supported by the retraction member extension portion, and permitting the keytop to be selectively manually depressed in the z direction to the lower actuation position when the retraction member is in the active state second position and the keytop is supported by the retraction member extension portion.

15. A key assembly, comprising:

a keytop having a main top surface and a main bottom surface;

an elastic column joined to the main bottom surface of the keytop and vertically collapsible from an uncollapsed, vertically extended first position to a collapsed, vertically compressed second position;

a support element joined to a lower extremity of said elastic column;

means for stabilizing and positioning the keytop, comprising a stabilizer arm joined to the keytop and extending exteriorly therefrom to an exterior extremity;

means joined to said exterior extremity for mounting said stabilizer arm on a base and allowing pivotable translation of the keytop and stabilizer arm;

a bearing surface structure which is selectively translatable between a registered position with the support element, and a non-registered position with the support element, arranged such that movement of the bearing surface structure to the registered position causes the keytop to be pivotally translated by the stabilizer arm to a raised active position from which the keytop is selectively depressible to a lower actuating position, and translation of the bearing surface structure to the non-registered position causes the keytop to be pivotally translated by the stabilizer arm to a down, inactive position; and a contact structure on the main bottom surface of the keytop, and a pressure sensitive switch layer on the base arranged so that contact structure on the main bottom surface of the keytop is (i) in non-contacting relationship to the pressure-sensitive switch layer when the keytop is in the raised active position, and (ii) in contacting relationship to the pressure-sensitive switch layer when the keytop is in the lower actuating position.

16. A key assembly according to claim 15, wherein the keytop has vertical side edge surfaces and a vertical front edge surface.

17. A key assembly according to claim 15, wherein said elastic column is constructed of a material selected from the group consisting of natural and synthetic rubbers, and polymeric elastomeric materials. The collapsible dome element is preferably constructed of material selected from the group consisting of natural and synthetic rubbers, and polymeric elastomeric materials.

18. A keyboard comprising an array of key assemblies including keytops arranged in an x-y array wherein the keytops in an active state are selectively manually actuatable in a z direction, and wherein each of said key assemblies comprises:

a key assembly base;

a pivotal mount structure positioned on the key assembly base and defining a pivotal translation axis;

a pivotally mounted stabilizer arm having (i) a first end portion joined to the pivotal mount structure for pivotable translation of the stabilizer arm about the pivotal mount structure axis of rotation when the keytops are in the active state, and (ii) a second end portion joined to the keytop;

means for positioning the keytop in an upper elevation position in the active state and permitting the keytop in said active state to be selectively manually depressed in the z direction to a lower actuation position, said positioning means comprising:

a retraction member mounted on the key assembly base, for slidable movement thereon in the y direction between a retracted first position and an active state second position, said retraction member including an extension portion for supportively elevating the keytop to the upper elevation position when the retraction member is in the active state second position, and said retraction member extension portion being non-engaged with the keytop when the retraction member extension portion is in the retracted first position; and a biasing element for biasingly maintaining the keytop in the upper elevation position in the absence of selective manual depression of the keytop when the retraction member is in the active state second position and the keytop is supported by the retraction member extension portion, and permitting the keytop to be selectively manually depressed in the z direction to the lower actuation position when the retraction member is in the active state second position and the keytop is supported by the retraction member extension portion; and a contact structure on the main bottom surface of the keytop, and a pressure sensitive switch layer on the key assembly base arranged so that contact structure on the main bottom surface of the keytop is (i) in non-contacting relationship to the pressure-sensitive switch layer when the keytop is in the upper elevation position in the active state, and (ii) in contacting relationship to the pressure-sensitive switch layer when the keytop is depressed in the z direction to the lower actuation position.

19. A keyboard comprising an array of key assemblies including keytops arranged in the array in sequential horizontally extending, vertically spaced-apart rows, said key assemblies each comprising:

said keytops each having a main top surface and a main bottom surface;

an elastic column joined to the main bottom surface of the keytop and vertically collapsible from an uncollapsed, vertically extended first position to a collapsed, vertically compressed second position, said elastic column having a lower extremity;

a support element joined to said lower extremity of said elastic column;

means for stabilizing and positioning the keytop, comprising a stabilizer arm joined to the keytop and extending therefrom to an exterior extremity; means joined to said exterior extremity for mounting said stabilizer arm on a base and allowing pivotable translation of the keytop and stabilizer arm;

a beating surface structure which is selectively translatable between a registered position with the support element, and a non-registered position with the support element, arranged such that movement of the beating surface structure to the registered position causes the keytop to be pivotally translated by the stabilizer arm to a raised active position from which the keytop is selectively depressible to a lower actuating position, and translation of the bearing surface structure to the non-registered position causes the keytop to be pivotally translated by the stabilizer arm to a down, inactive position; and a contact structure on the main bottom surface of the keytop, and a pressure sensitive switch layer on the base arranged so that contact structure on the main bottom surface of the keytop is (i) in non-contacting relationship to the pressure-sensitive switch layer when the keytop is in the raised active position, and (ii) in contacting relationship to the pressure-sensitive switch layer when the keytop is in the lower actuating position.

wherein the stabilizer arm of at least one of the keying assemblies extends outwardly in the array to a next row of keytops and between two adjacent keytops of said row.

* * * * *

UNITED STATES PATENT AND TRADEMARK OFFICE

CERTIFICATE OF CORRECTION

PATENT NO. : 5,569,889

DATED : October 29, 1996

INVENTOR(S) : Bruner, David A.

It is certified that error appears in the above-indentified patent and that said Letters Patent is hereby corrected as shown below:

| | |
|---|---|
| Column 4, Line 20 | ";in which" should be --in which-- |
| Column 11, Line 64 | "beating" should be --bearing-- |
| Column 16, Line 4 | "beating" should be --bearing-- |

Signed and Sealed this

Eighteenth Day of March, 1997

*Attest:*

Bruce Lehman

BRUCE LEHMAN

*Attesting Officer*

*Commissioner of Patents and Trademarks*